United States Patent [19]

Kuraishi

[11] 4,155,031

[45] May 15, 1979

[54] ELECTRONIC FLASH APPARATUS

[75] Inventor: Kaoru Kuraishi, Tokyo, Japan

[73] Assignee: Toshiba Photo Products Co., Ltd., Tokyo, Japan

[21] Appl. No.: 798,612

[22] Filed: May 19, 1977

[30] Foreign Application Priority Data

Sep. 9, 1976 [JP] Japan ..... 51-108116
Sep. 9, 1976 [JP] Japan ..... 51-108117

[51] Int. Cl.[2] ..... H05B 41/32

[52] U.S. Cl. ..... 315/241 P; 315/159; 315/151

[58] Field of Search ..... 315/151, 159, 241 P; 358/35, 128, 145

[56] References Cited

U.S. PATENT DOCUMENTS

| | | | |
|---|---|---|---|
| 3,740,610 | 6/1973 | Roncke | 315/241 P |
| 3,783,336 | 1/1974 | Vital et al. | 315/159 |
| 3,896,333 | 7/1975 | Nakamura | 315/151 |
| 3,998,534 | 12/1976 | Schulze et al. | 315/241 P X |

*Primary Examiner*—Eugene R. La Roche

*Attorney, Agent, or Firm*—Darby & Darby

[57] ABSTRACT

An electronic flash apparatus comprises a discharge circuit and termination circuit for terminating the discharge circuit. The discharge circuit comprises an energy storage capacitor and a series circuit formed of a flash tube and a first switching element connected in parallel to the energy storage capacitor. The first switching element is rendered inoperative by a reverse voltage which is temporarily supplied when energy stored in a commutation capacitor of the termination circuit is discharged by a second switching element. When a prescribed period of time has passed after the first switching element is turned off, the switching element is again put into operation by a retrigger circuit. The commutation capacitor is reversely charged through the flash tube after the first switching element is turned off. The reverse charge is discharged by the retrigger of the first switching element. The discharge of energy stored in the reversely charged commutation capacitor shortens a length of time required for the termination circuit to be charged again through the normal path.

15 Claims, 8 Drawing Figures

ELECTRON FLASH APPARATUS

BACKGROUND OF THE INVENTION

This invention relates to an electronic flash apparatus for a photographic purpose and more particularly to improvements on the electronic flash apparatus which is provided with a termination circuit for terminating a discharge circuit.

Already known is an electronic flash apparatus which is provided with a termination circuit for terminating a discharge circuit and can emit a desired amount of light by restricting the period of time for which a flash tube is allowed to give forth light. There will now be briefly described the prior art electronic flash apparatus by reference to the circuit diagram of FIG. 1.

The electronic flash apparatus of FIG. 1 comprises a D.C. power source 2, a discharge circuit 4 for discharging electric energy supplied by the D.c. source 2 and a termination circuit 6 for terminating a discharge by the discharge circuit 4. The discharge circuit 4 comprises an energy storage capacitor 7 connected between the positive and negative terminals of the D.C. power source 2; and a series circuit formed of a flash tube 8 and a first silicon controlled rectifier (hereinafter abbreviated as "SCR") 10 and connected in parallel to the energy storage capacitor 7. When the SCR 10 and flash tube 8 are energized, and discharge circuit 4 discharges electric energy stored in the energy storage capacitor 7 charged by the D.C. power source 2, thereby emitting a flash from the flash tube 8.

The flash tube 8 is energized when its trigger electrode is supplied with high voltage pulses emitted by a high voltage pulse generator 14 interlocking with the operation of a control circuit 12. Like the flash tube 8, the first SCR 10 is energized when its gate is impressed with a trigger voltage produced by a trigger circuit 13 interlocking with the control circuit 12. The control circuit 12 is generally included in the camera shutter and operated by a switch 11 which is closed interlockingly with the movement of a shutter blade or blind.

With termination circuit 6 for terminating the discharge circuit 4, a series circuit of a commutation capacitor 16 and a second SCR 18 jointly constituting a reverse voltage passage is connected in parallel to the first SCR 10. To form a charge passage for the commutation capacitor 16, a resistor 20 is connected between the common junction of one end of the commutation capacitor 16 and the second SCR 18 on one hand and the positive terminal of the D.C. power source 2 on the other. Further, a resistor 22 is connected between the other end of the commutation capacitor 16, and the negative terminal of the D.C. power source 2 on the other. The termination circuit 6 energized the second SCR 18 to cause energy stored in the commutation capacitor 16 to be discharged, thereby temporarily applying a reverse voltage across the anode and cathode of the first SCR 10 and in consequence rendering the first SCR 10 nonconducting. When the first SCR 10 becomes inoperative, then the discharge circuit 4 is cut off. Later, the flash tube 8 terminates to emit flash. The second SCR 18 is energized by a trigger circuit 26 which produces a trigger voltage upon receipt of a signal from a timer or photoelectric converter 24. However, the prior art electronic flash apparatus of the above-mentioned arrangement has the drawback that since the commutation capacitor 16 takes much time to be charged again, the electronic flash apparatus needs a long time to be made ready for each succeeding emission of flash through the charge of the commutation capacitor 16. Generally, even when the first SCR 10 is rendered nonconducting, the impedance of the flash tube 8 does not immediately increase, but causes discharge current to continue to flow through the flash tube 8 for a short time. As the result, the commutation capacitor 16 is charged through a path formed of the flash tube 8, the commutation capacitor 16 and second SCR 18. When the commutation capacitor 16 is charged through the flash tube 8, then the charge takes place with a different polarity from the case where charging is normally carried out through the resistors 20, 22, namely, with a reverse polarity as shown by the + and − notations enclosed in parentheses. Where, therefore, the commutation capacitor 16 should be charged through the normal path, namely, through the resistors 20, 22, it is necessary to continue charging until the polarity is charged from the reverse to the normal operative form, thus requiring much time for storage of energy in the commutation capacitor 16.

SUMMARY OF THE INVENTION

It is accordingly the object of this invention to provide an electronic flash apparatus which, after a flash, can shorten a period required for each succeeding flash to be made.

According to an aspect of this invention, there is provided an electronic flash apparatus which comprises an energy storage capacitor connected to a D.C. power source; a discharge circuit formed of a series circuit including a flash tube and a first switching element and connected in parallel to the energy storage capacitor; and a termination circuit formed of a commutation capacitor connected to the D.C. power source and a second switching element connected in series to the commutation capacitor, and connected in parallel to the first switching element of the discharge circuit, thereby temporarily applying a reverse voltage on the first switching element to terminate its operation, and wherein the first switching element terminating circuit further includes a retrigger circuit for retriggering the first switching element in response to a prescribed level of the voltage of energy stored in the commutation capacitor reversely charged through the flash tube after the termination of the first switching element.

There will now be described the embodiments of an electronic flash apparatus according to this invention by reference to the appended drawings. Throughout the embodiments, the same parts of the electronic flash apparatus are denoted by the same numerals.

BRIEF DESCRIPTION OF THE DRAWINGS

FIG. 3(*b*) indicates the waveform of a signal, showing in time sequence the nonconductive and conductive of the second SCR of FIG. 2;

FIG. 3(*c*) sets forth waveform of a signal, showing a charge with time in the magnitude of current flowing through a flash tube of FIG. 2;

FIG. 3(*d*) gives the waveform of a signal, showing a charge with time in the level of the voltage of energy stored in a commutation capacitor of FIG. 2;

FIG. 3(*e*) indicates the waveform of a signal, showing a charge with time in the level of the voltage of energy stored in a restart capacitor of FIG. 2;

FIG. 5(*b*) indicates the waveform of a signal, showing in time sequence the nonconductive and conductive of the second SCR of FIG. 4;

FIG. 5(*c*) sets forth the waveform of a signal, showing a charge with time in the magnitude of current flowing through a third switching element of FIG. 4;

FIG. 5(*d*) gives the waveform of a signal, showing a charge with time in the magnitude of discharge current passing through a flash tube of FIG. 4;

FIG. 5(*e*) presents the waveform of a signal, showing a charge with time in the level of the voltage of energy stored in a commutation capacitor of FIG. 4;

FIG. 5(*f*) sets forth the waveform of a signal, showing a charge with time in the level of the voltage of energy stored in a restart capacitor of FIG. 4.

DESCRIPTION OF THE PREFERRED EMBODIMENTS

Figure 1:
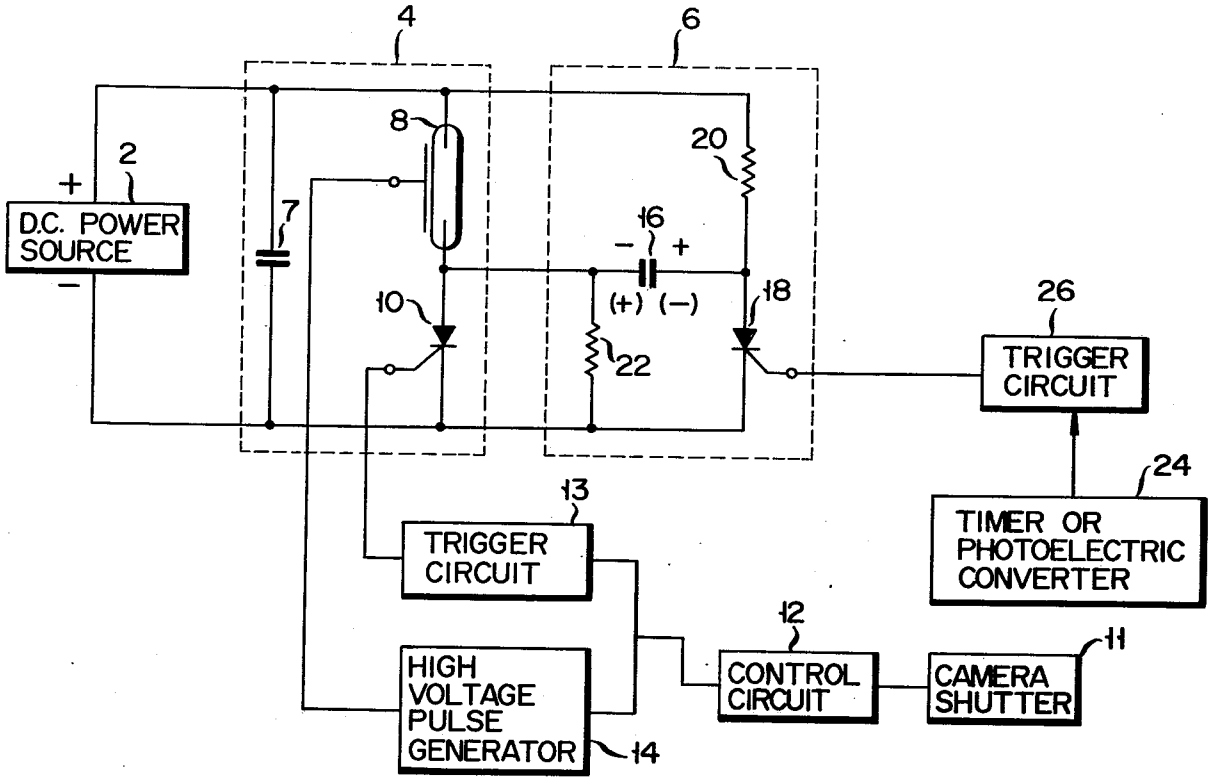
FIG. 1 PRIOR ART
FIG. 1 is a circuit diagram of the prior art electronic flash apparatus.
Figure 2:
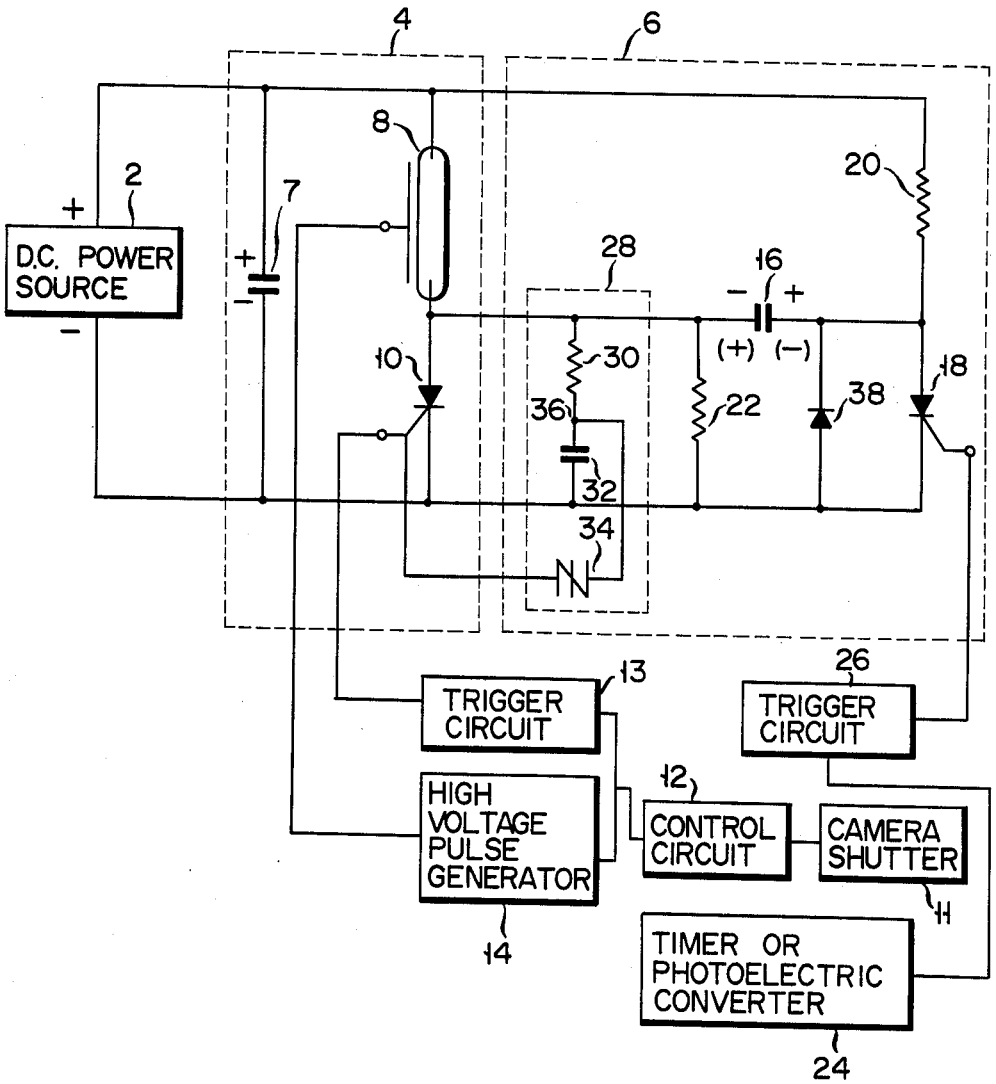
FIG. 2 is a circuit diagram of an electronic flash apparatus according to one embodiment of this invention.

FIG. 2 shows the fundamental circuit arrangement of an electronic flash apparatus according to one embodiment of this invention. The electronic flash apparatus comprises a discharge circuit 4 and a termination circuit 6 terminating the discharge circuit 4. It is seen from FIG. 2 that this invention has improved termination circuit 6 for terminating the discharge circuit 4. Fundamentally, the termination circuit of FIG. 2 has the same circuit arrangement as that of FIG. 1, namely, is formed of an energy storage capacitor 7, flash tube 8 and SCR 10. The trigger electrode of the flash tube 8 is connected to the high voltage pulse generator 14, and the gate of the first SCR 10 is connected to the trigger circuit 13. The trigger circuit 13 and high voltage pulse generator 14 are connected to the camera shutter 11 through the control circuit 12.

As in FIG. 1, the termination circuit 6 comprises a series circuit formed of a commutation capacitor 16 and second SCR 18 and connected in parallel to the first SCR 10. The junction of one end of the commutation capacitor 16 and the second SCR 18 is connected to the positive terminal of the D.C. power source 2 through the resistor 20. The common junction of the other end of the commutation capacitor 16, flash tube 8 and first SCR 10 is connected to one end of the D.C. power source 2 through the resistor 22. Further as in FIG. 1, the gate of the second SCR 18 is connected to the trigger circuit 26, which is actuated by a signal supplied from, for example, a timer or photoelectric converter 24. According to this invention, the termination circuit 6 is provided with a retrigger circuit 28 for retriggering the gate of the first SCR 10 to discharge energy stored in the commutation capacitor 16 reversely charged by temporarily operating the first SCR 10 for a second time. The retrigger circuit 28 comprises a series circuit formed of a resistor 30 and retrigger capacitor 32 and connected in parallel to the first SCR 10; and a trigger diode 34 connected between a junction 36 of the resistor 30 and retrigger capacitor 32 are one hand and the gate of the first SCR 10 on the other. The termination circuit 6 further comprises a diode 38 connected in parallel backward relative to the forward disposed second SCR 18 in order to discharge energy stored in the commutation capacitor 16 when the first SCR 10 is retriggered.

There will now be described by reference to the waveforms of signals shown in FIGS. 3(*a*) to 3(*e*) the electronic flash apparatus of this invention arranged as described above. Where the power source switch (not shown) of the electronic flash apparatus is closed, then the energy storage capacitor 7 is charged by the D.C. power source 2. At this time, the commutation capacitor 16 is also stored with energy through a closed circuit formed of the D.C. power source 2, resistor 20, commutation capacitor 16 and resistor 22. When the energy storage capacitor 7 and commutation capacitor 16 are fully charged, then the electronic flash apparatus is made ready for flashing and subsequent cutoff.

Where the camera shutter 11 is actuated a certain length of time after the electronic flash apparatus fully gets ready for flashing, then the control circuit 12, the trigger circuit 13 and high voltage pulse generator 14 are put into operation by the closing of a switch interlocking with the camera shutter 11. When a trigger pulse sent forth from the trigger circuit 13 through the control circuit 12 is supplied to the gate of the first SCR 10, then the first SCR 10 is started into a conducting condition. Almost at the same time, a high voltage pulse sent forth from the high voltage pulse generator 14 is delivered to the trigger electrode of the flash tube 8, which in turn emits flashes. Where the first SCR 10 and flash tube 8 are energized, then energy stored in the energy storgae capacitor 7 begins to flow in the form of transient current through the first SCR 10 and flash tube 8 as shown by time $T_1$ given in FIGS. 3(*a*) and 3(*c*) which show a charge with time in the magnitude of current flowing through the first SCR 10 and flash tube 8 respectively. The transient current causes the flash tube 8 to commence flashing at time $T_1$.

Later, the flash tube 8 emits flashes on to a foreground oject. When the photoelectric converter 24 for detecting an amount of reflections from the foreground object detects a prescribed amount of reflections, then the trigger circuit 26 is put into operation. The photoelectric converter 24 may be replaced by a timer designed to actuate the trigger circuit 26 after the flash tube 8 has continued to flash for a prescribed length of time. When operated, the trigger circuit 26 supplies a trigger pulse to the gate of the second SCR 18. When supplied with a trigger pulse, the second SCR 18 rendered conducting at time $T_2$ as shown in FIG. 3(*b*). The commutation capacitor 16 begins to discharge energy stored therein through the second SCR 18. As the result, the voltage of the commutation capacitor 16 rapidly drops after time $T_2$ as shown in FIG. 3(*d*) indicating a charge with time in the level of the voltage stored in said commutation capacitor 16. The first SCR 10 is temporarily impressed with a reverse voltage due to the discharge of the commutation capacitor 16 through the second SCR 18. The first SCR 10 becomes nonconductive as illustrated in FIG. 3(*a*), at time $T_3$ when the second SCR 18 is rendered conducting. As the result, the discharge passage of the discharge circuit 4 formed of the energy storage capacitor 7, flash tube 8 and first SCR 10 is shut off.

Since an impedance between the anode and cathode of the flash tube 8 does not rapidly increase even when the discharge passage of the discharge circuit 4 is shut off, the flash tube 8 is supplied with of discharge current from the energy storage capacitor 7. The discharged energy flows in the form of transient current through the path of the flash tube 8, commutation capacitor 16 and second SCR 18, causing the commutation capacitor 16 to be reversely charged as showwn in FIG. 3(*d*). Namely, the commutation capacitor 16 is charged with a reverse polarity from that with which said commutation capacitor 16 is normally charged, as seen from the + and − notations enclosed in parentheses in FIG. 2.

Figure 3:
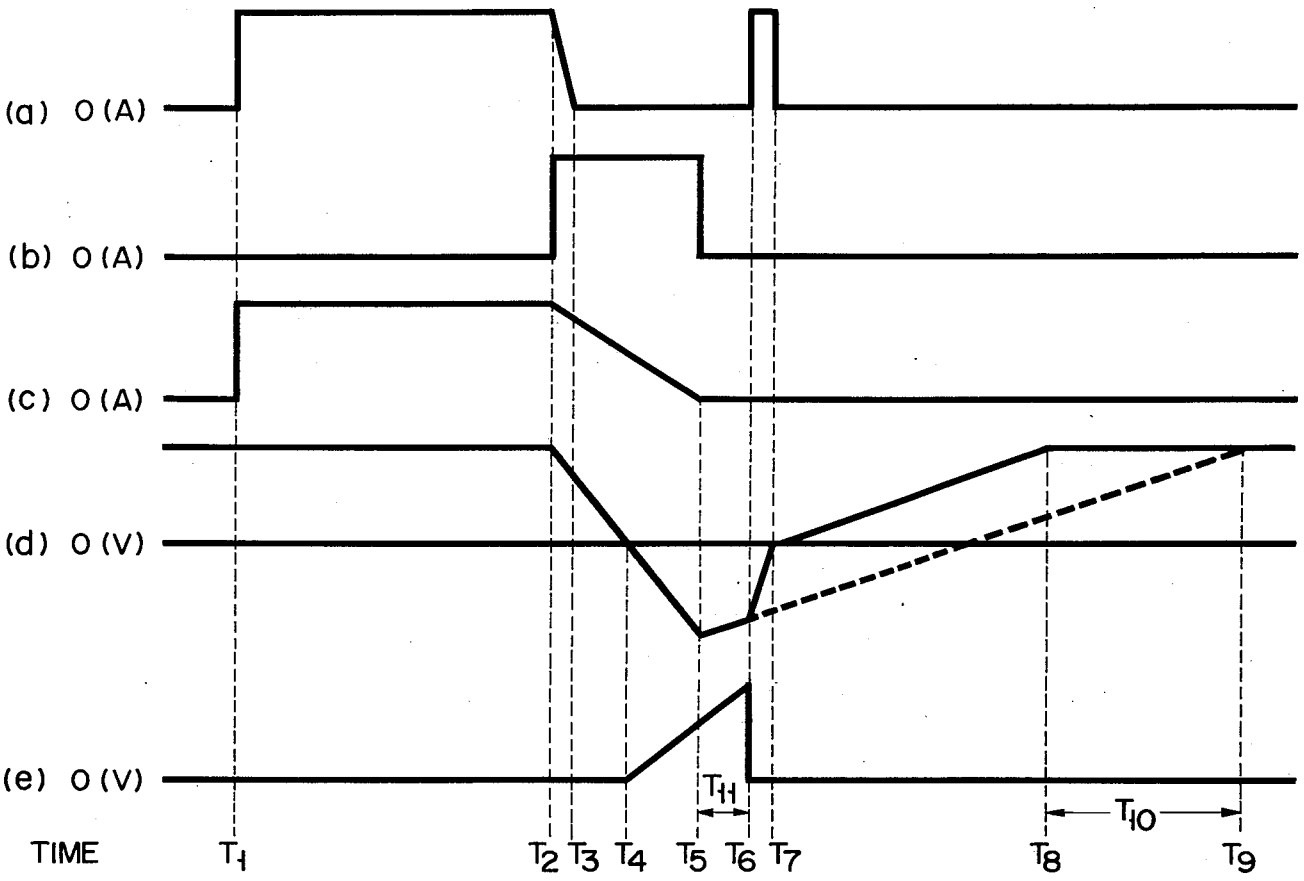
FIG. 3(*a*) presents the waveform of a signal, showing in time sequence the nonconductive and conductive of the first SCR of FIG. 2.

When the commutation capacitor 16 is reversely charged, then the retrigger capacitor 32 is charged through the flash tube 8 and resistor 30 at time $T_4$ as shown in FIG. 3(*e*) presenting a change with time in the level of the voltage of energy stored in the commutation capacitor 16. When the retrigger capacitor 32 is charged, a potential at the junction 36 of the capacitor 32 and resistor 30 rapidly rises as illustrated in FIG. 3(*e*). When a potential at the junction reaches a prescribed level at time $T_5$ as shown in FIG. 3(*e*), then the trigger diode 34 is actuated, causing a trigger pulse to be supplied to the gate of the first SCR 10 which was previously triggered and then turned off. Accordingly, the first SCR 10 is temporarily rendered conducting at time $T_6$ as shown in FIG. 3(*a*). When the first SCR 10 becomes operative again, energy stored in the reversely charged commutation capacitor 16 is discharged through the first SCR 10 and diode 38, because the discharge of the flash tube 8 is already brought to an end at time $T_5$ as shown in FIG. 3(*c*). As the result, the commutation capacitor 16 has its voltage reduced to a zero level, and is charged through a normal path at time $T_7$ of FIG. 3(*d*). At time $T_8$, namely, a prescribed length of time after the commutation capacitor 16 is charged through the normal path, said commutation capacitor 16 is charged to a sufficient voltage level to actuate the termination circuit 6 of the electronic flash apparatus.

The first SCR 10 is rendered nonconductive at time $T_7$ when current ceases to be discharged from the commutation capacitor 16. The second SCR 18 is automatically turned off when the discharge of the commutation capacitor 16 is brought to the end.

A time interval $T_{11}$ arises between time $T_5$ when the discharge of the flash tube 8 stops and time $T_6$ when the first SCR 10 is retriggered. This time interval $T_{11}$ is provided as a protective period to supress the inadvertent flashing of the flash tube 8. The protective period $T_{11}$ should be as short as possible to reduce the time required for the commutation capacitor 16 to be discharged and again charged.

With the above-mentioned electronic flash apparatus according to one embodiment of this invention, a time required for the commutation capacitor 16 to be restored and in consequence a time required for the termination circuit 6 to be restarted are more shortened than in the case of the prior art electronic flash apparatus. Where, as in the prior art electronic flash apparatus, the termination circuit 6 is not provided with a retrigger circuit 28, the first SCR 10 is not retriggered. Consequently, the commutation capacitor 16 is progressively charged with the polarity changed from the reverse form to the normal form with which charging takes place through the resistors 20, 22. At time $T_9$ shown in FIG. 3(*d*), therefore, the commutation capacitor 16 is charged up to a sufficiently high voltage level to actuate the termination circuit 6. In contrast, with the termination circuit 6 of this invention which is provided with the retrigger circuit 28, the first SCR 10 is temporarily rendered conducting, and energy stored in the reversely charge commutation capacitor 16 is discharged, thereby shortening a time required for the commutation capacitor 16 to be normally charged by a time interval of $T_{10}$.

There will now be described by reference to FIGS. 4 to 8 the arrangement and operation of an electronic flash apparatus according to other embodiments of this invention. The electronic flash apparatus of FIG. 4 has substantially the same arrangement as that of FIG. 2. The only difference is that the embodiment of FIG. 4 comprises a third switching element 40. This third switching element 40 is, for example, a quench tube or cold cathode type thyratron, and is connected in parallel to the flash tube 8. The trigger electrode of the third switching element 40 is connected to the high voltage pulse generator 42.

Figure 5:
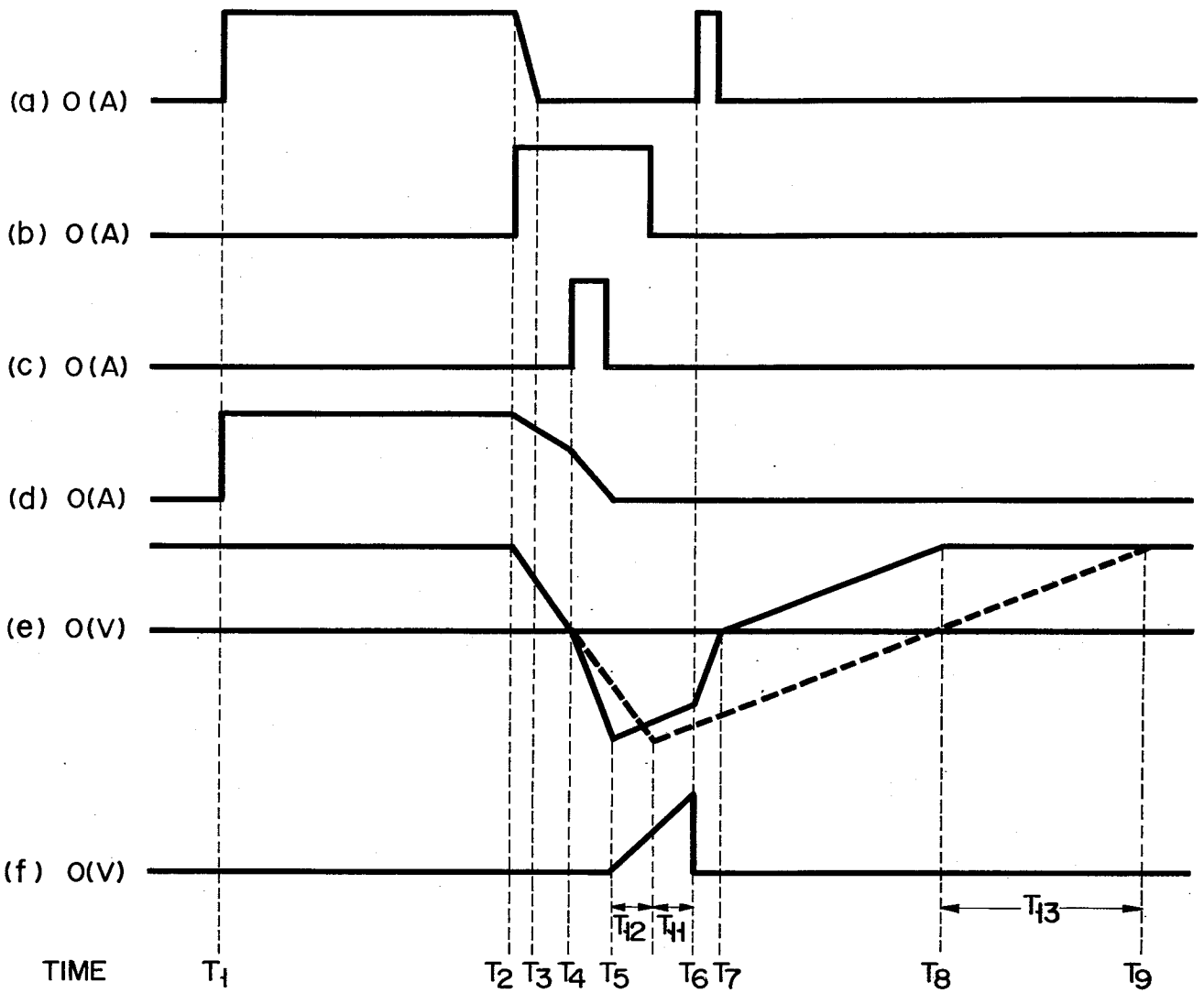
FIG. 5(*a*) presents the waveform of a signal, showing in time sequence the nonconductive and conductive of the first SCR of FIG. 4.

The operation of an electronic flash apparatus will now be described by reference to FIG. 5. When the first SCR 10 is rendered conductive at time $T_1$, also in same time a trigger pulse is supplied to the trigger electrode of the flash tube 8, thereby causing current to flow through the first SCR 10 and flash tube 8 as shown in FIGS. 5(*a*) and 5(*d*) indicating a change with time in the magnitude of current flowing through the first SCR 10 and flash tube 8 respectively. As the result, the flash tube 8 commences flashing. Later at time $T_2$, as shown in FIG. 5(*b*) indicating a change with time in the magnitude of current flowing through the second SCR 18, the second SCR 18 is rendered conducting, causing energy stored in the commutation capacitor 16 to be discharged, as shown in FIG. 5(*e*) indicating a change with time in the level of the voltage of energy stored in the commutation capacitor 16. Accordingly, the first SCR 10 is impressed with a reverse voltage and becomes nonconductive at time $T_3$. Even when the first SCR 10 is rendered nonconducting, the flash tube 8 does not immediately stop a discharge, tube the discharge current still continues to flow through the tube 8 temporarily, causing the commutation capacitor 16 to be reversely charged. When the high voltage pulse generator 42 is operated at time $T_4$ is FIG. 5(*c*) indicating a change with time in the magnitude of current flowing through the third switching element 40 to render said switching element 40 conducting, then the commutation capacitor 16 is reversely charged immediately as shown in FIG. 5(*e*). When rendered conducting, the third switching element 40 has a smaller impedance than the flash tube 8. Therefore, transient current flowing through the flash tube 8 after the turn-off the first SCR 10 is conducted to the commutation capacitor 16 through the third switching element 40 which is now rendered conducting. When the commutation capacitor 16 is reversely charged and the potential at the junction 36 of the retrigger capacitor 32 and resistor 30 rises to a prescribed level, then the trigger diode 34 is actuted at time $T_6$ to render to first SCR 10 conducting. Accordingly, energy stored in the reversely charged commutation capacitor 16 is discharged through the first SCR 10 and diode 38. Later, the commutation capacitor 16 is charged to a prescribed voltage level through the normal path, that is, through the resistors 20, 22.

Figure 4:
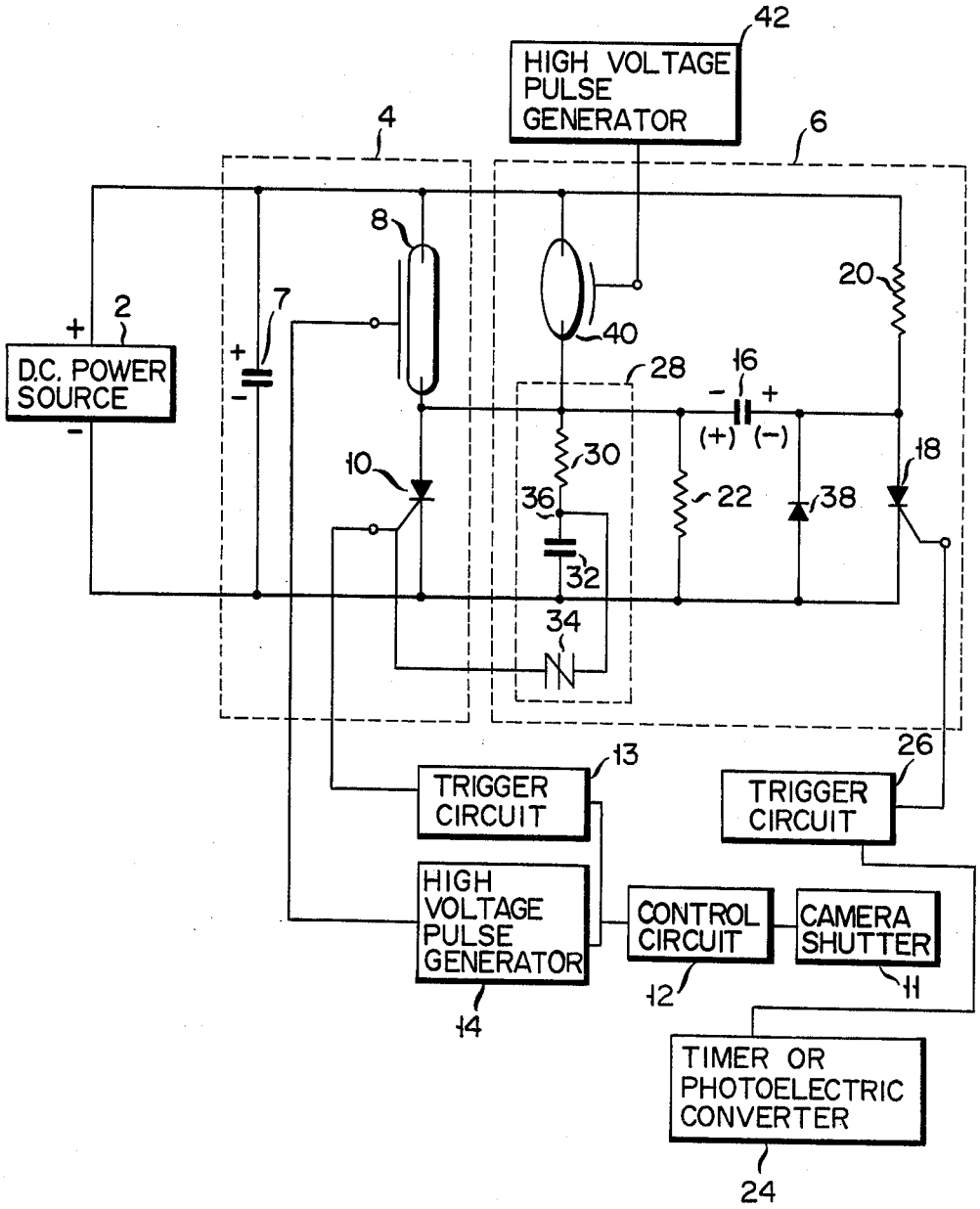
FIG. 4 is a circuit diagram of an electronic flash apparatus according to another embodiment of the invention.

With the termination circuit 6 according to another embodiment of this invention shown in FIG. 4, the commutation capacitor 16 is rapidly charged reversely by the third switching element 40. Namely, the commutation capacitor 16 is reversely charged more quickly by a time interval of $T_{12}$ as shown in FIG. 5(*e*) than in the embodiment of FIG. 2. Moreover, the flash tube 8 can be made to stop flashing in a shorter time than in the embodiment of FIG. 2. Accordingly, the embodiment of FIG. 4 enables the commutation capacitor 16 to be charged more rapidly by a time interval $T_{13}$ than the prior art electronic flash apparatus.

There will now be described by reference to FIGS. 6 to 8 the concrete arrangement of the high voltage pulse generator 42 for the third switching element 40.

Figure 6:
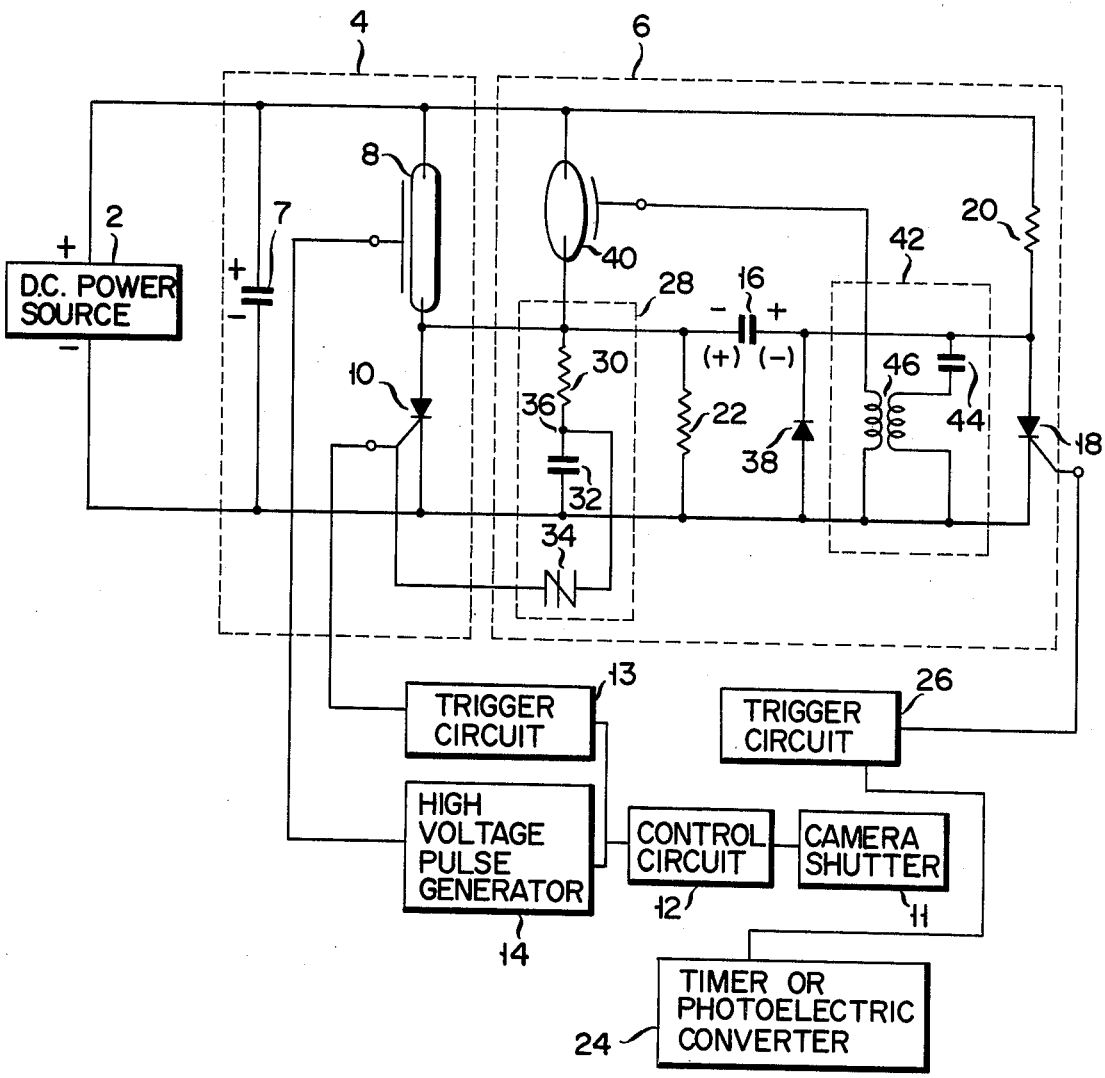
FIGS. 6 to 8 are concrete circuit diagrams of various embodiments of the high voltage pulse generator 42 of FIG. 4.

The high voltage pulse generator 42 of FIG. 6 comprises a pulse transformer 46 whose secondary winding is connected between the trigger electrode of the third switching element 40 and the negative terminal of the D.C. power source 2, and whose primary winding is connected through a capacitor 44 between the junction of the resistor 20 and second SCR 18 on one hand and the negative terminal of the D.C. power source 2 on the other. When the second SCR 18 is rendered conducting, energy stored in the capacitor 44 is discharged. Therefore a high voltage pulse produced in the secondary winding of the pulse transformer 46 of the high voltage pulse generator 42 actuates the third switching element 40.

Figure 7:
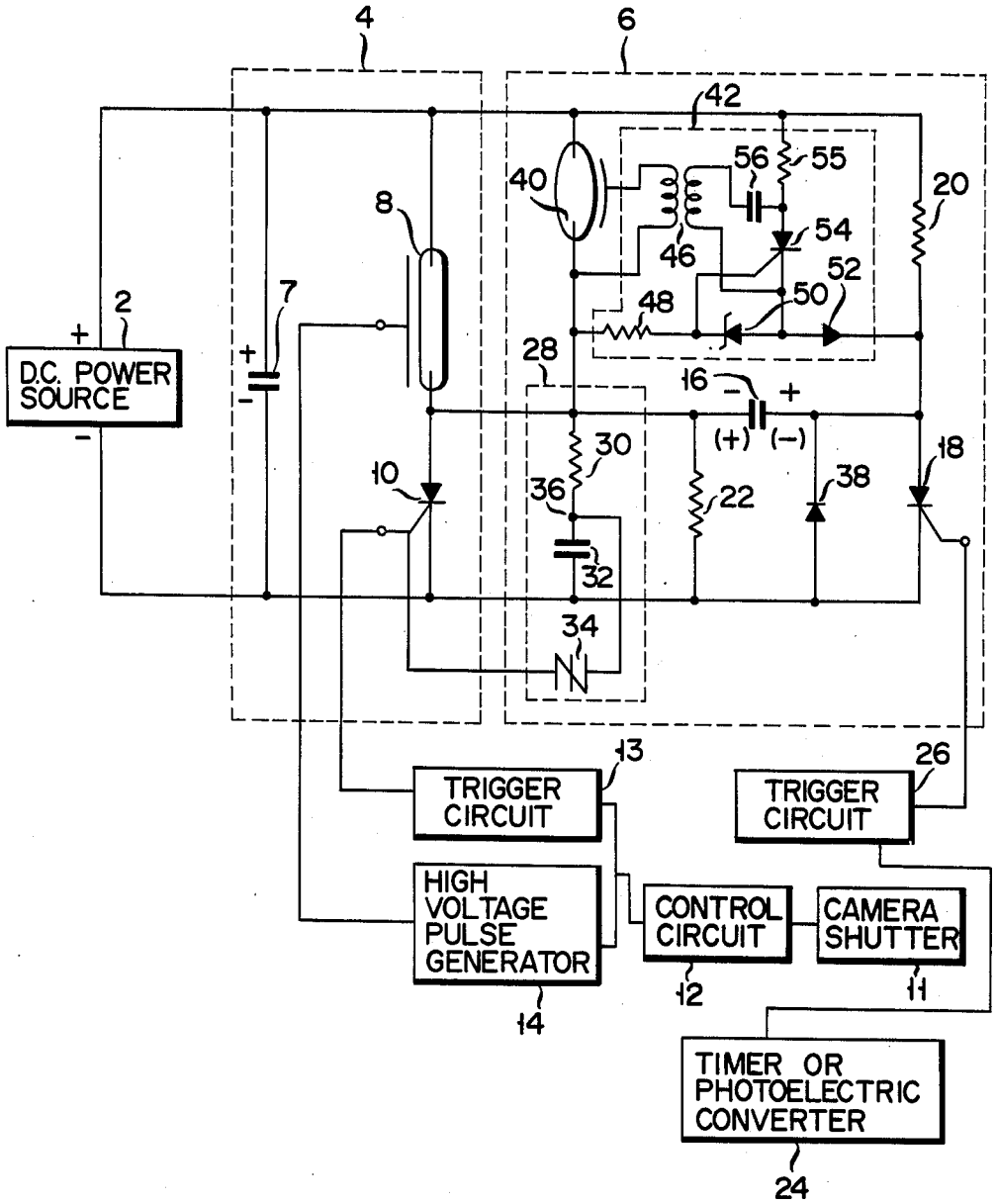

The high voltage pulse generator 42 of FIG. 7 comprises a series circuit formed of a resistor 48, Zener diode 50 and diode 52 and connected in parallel to the commutation capacitor 16; a fourth switching element 54 whose cathode is connected to the junction of the Zener diode 50 and diode 52, whose anode is connected to the positive terminal of the D.C. power sourge through the resistor 55 and whose gate is connected to the junction of the resistor 48 and Zener diode 50; and a pulse transformer 46 whose primary winding is connected through a capacitor 56 between the junction of the anode of the fourth switching element 54 and resistor 55 on one hand and the cathode of the switching element 54 on the other, and whose secondary winding is connected between the trigger electrode of the third switching element 40 and the cathode of the switching element 40.

There will now be described the operation of the high voltage pulse generator 42 of FIG. 7. Where, as previously described, the second SCR 18 is rendered conducting, and the first SCR 10 becomes nonconductive upon impression of a reverse voltage by the commutation capacitor 16, then a potential at the junction of the resistor 48 and Zener diode 50 is slowly increased. When the potential at the junction reaches a prescribed level, then the Zener diode 50 is rendered conductive. As the result, a signal is supplied to the gate of the fourth switching element 54 for its operation. When the fourth switching element 54 is actuated, energy stored in the capacitor 56 is set off through the primary winding of the pulse transformer 46 to generate a trigger pulse in the secondary winding of the pulse transformer 46, causing the third switching element 40 to be rendered conducting.

Figure 8:
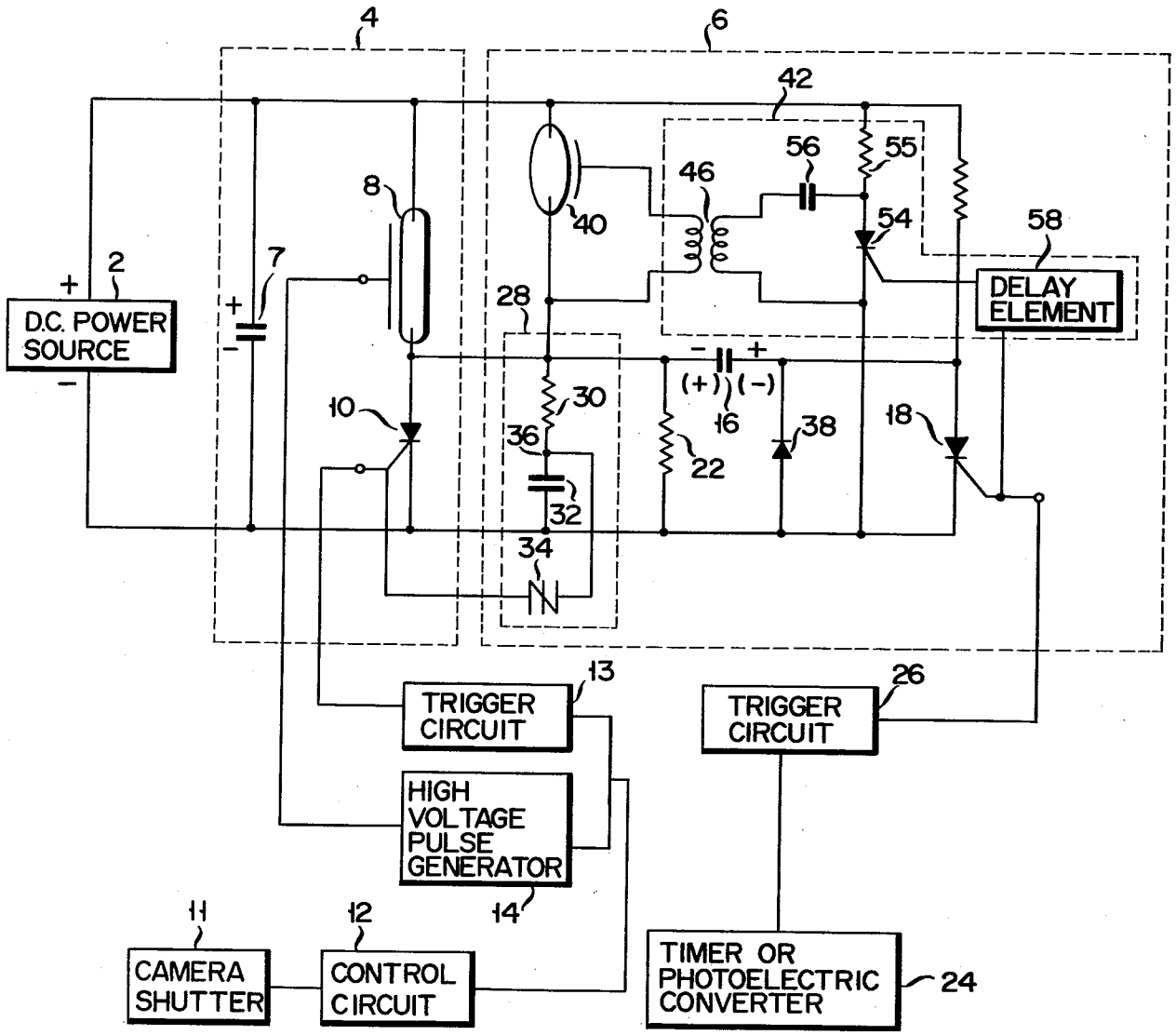

The high voltage pulse generator 42 of FIG. 8 includes a delay element 58, which is connected between the gate of the second SCR 18 and that of the fourth switching element 54. The fourth switching element 54 is connected to the D.C. power source 2 through a resistor 55. Series circuit of the primary winding of the pulse transformer 46 and the capacitor 56 is connected in parallel to the fourth switching element 54. The both secondary winding terminals of the pulse transformer 46 are connected to the trigger electrode and cathode of the third switching element 40. The delay element 58 delays a trigger pulse supplied to the second SCR 18 to start the third switching element 40. When a gate pulse delay by the delay element 58 is supplied to the fourth switching element 54 then a trigger pulse is produced in the secondary winding of the pulse transformer 46 to trigger the third switching element 40.

The second switching element 18 used in the foregoing embodiments is not the SCR type, but may be, for example, a cold cathode type thyratron.

As described above, this invention provides an electronic flash apparatus which can shorten a period required for any succeeding flashing to be made after the proceeding one and also control an amount of flashing each time.

What is claimed is:

1. An electronic flash apparatus comprising:

a discharge circuit including an energy storage capacitor connected to a d.c. power source, and a series circuit including a flash tube and a first switching element having a gate and connected in parallel to said energy storage capacitor;

a termination circuit for temporarily applying a reverse voltage to said first switching element thereby cutting off said first switching element, said termination circuit including a commutation capacitor, and a second switching element having a gate and connected in series with the commutation capacitor and in parallel to said first switching element;

a charging circuit including a resistor connected to said commutation capacitor for charging said commutation capacitor; and a retrigger circuit for retriggering said first switching element when said commutation capacitor is reversely charged through said flash tube to a predetermined potential after the cutoff of said first switching element, said retrigger circuit comprising a series circuit including a resistor and capacitor connected in parallel to said first switching element, and a voltage responsive element connected between the gate of said first switching element and the junction point of the resistor and the capacitor.

2. The electronic flash apparatus according to claim 1, wherein the voltage-responsive element is a trigger diode.

3. The electronic flash apparatus according to claim 1, wherein the termination circuit includes a diode connected between the commutation capacitor and the first switching element to provide a discharge passage for energy stored in the commutation capacitor when reversely charged.

4. The electronic flash apparatus according to claim 1, wherein the first and the second switching elements are silicon controlled rectifiers.

5. The electronic flash apparatus according to claim 1, wherein the first switching element is a silicon controlled rectifier, and the second switching element is a silicon controlled rectifier.

6. The electronic flash apparatus according to claim 1 wherein the termination circuit includes a third switching element which is connected in parallel to the flash tube to constitute a passage of discharge current energized immediately after the cut-off the first switching element.

7. The electronic flash apparatus according to claim 6, wherein the third switching element is a semiconductor switching element.

8. The electronic flash apparatus according to claim 6, wherein the third switching element is a quench tube.

9. The electronic flash apparatus according to claim 6, wherein the third switching element is a silicon controlled rectifier.

10. The electronic flash apparatus according to claim 6, wherein the third switching element is a cold cathode type thyratron.

11. The electronic flash apparatus according to claim 6, wherein the high voltage pulse generator connected to the control electrode of the third switching element further comprises a detection circuit for detecting the reversion of the polarity of the commutation capacitor, which is connected in parallel to the commutation capacitor and comprises at least one resistor and one Zenor diode, said high voltage pulse generator being operated by an output signal from the detection circuit which has detected the reversion of the polarity of the commutation capacitor.

12. The electronic flash apparatus according to claim 11, wherein the high voltage pulse generator connected to the control electrode of the third switching element further comprises a fourth switching element; and an output signal from the detection circuit which has detected the reversion of the polarity of the commutation capacitor actuates the third switching element thereby to operate the high voltage pulse generator.

13. The electronic flash apparatus according to claim 6, wherein the high voltage pulse generator connected to the control electrode of the third switching element is formed of a transformer, whose primary winding is connected in parallel to the second switching element through a capacitor and whose secondary winding is connected to the third switching element.

14. The electronic flash apparatus according to claim 6, wherein the high voltage pulse generator connected to the control electrode of the third switching element further comprises a delay element, and is operated by a signal supplied to the control electrode of the second switching element and then conducted through the delay element.

15. The electronic flash apparatus according to claim 6, wherein the high voltage pulse generator further includes the third switching element and a transformer.

* * * * *